US010501969B2

(12) United States Patent
Patrick

(10) Patent No.: US 10,501,969 B2
(45) Date of Patent: Dec. 10, 2019

(54) ENCAPSULATED FLEXIBLE HINGES

(71) Applicant: Unhinged Solutions LLC, Palm City, FL (US)

(72) Inventor: Steve Patrick, Palm City, FL (US)

(73) Assignee: Unhinged Solutions LLC, Palm City, FL (US)

( * ) Notice: Subject to any disclaimer, the term of this patent is extended or adjusted under 35 U.S.C. 154(b) by 7 days.

(21) Appl. No.: 15/878,695

(22) Filed: Jan. 24, 2018

(65) Prior Publication Data

US 2018/0238090 A1 Aug. 23, 2018

Related U.S. Application Data

(60) Provisional application No. 62/462,814, filed on Feb. 23, 2017.

(51) Int. Cl.

| | |
|---|---|
| ***E05D 1/00*** | (2006.01) |
| ***E05D 1/02*** | (2006.01) |
| ***E05D 9/00*** | (2006.01) |

(52) U.S. Cl.

CPC ..... *E05D 1/02* (2013.01); *E05D 9/005* (2013.01); *E05Y 2900/602* (2013.01)

(58) Field of Classification Search

CPC ..... Y10T 16/525; Y10T 16/548; E05D 1/00; E05D 1/02; E05D 1/06; E05D 9/005; E05D 7/00; E05Y 2800/68; E05Y 2800/344; E05Y 2800/676; E05Y 2800/678; E05Y 2900/602; B29L 2031/22; B29C 51/00; B29C 65/70; B29C 65/30; B29C 66/71; B29C 66/712; B29K 2105/06; B29K 2105/089; F16C 11/12

See application file for complete search history.

(56) References Cited

U.S. PATENT DOCUMENTS

| | | | | |
|---|---|---|---|---|
| 2,331,512 A | | 10/1943 | Siedschlag | |
| 2,526,129 A | * | 10/1950 | Groesbeck | E05D 1/02 16/225 |
| 2,607,411 A | * | 8/1952 | Van Vliet | E05D 1/02 16/225 |
| 3,019,486 A | * | 2/1962 | Stinson | B29C 53/063 135/909 |
| 5,350,614 A | * | 9/1994 | Chase | B32B 27/04 428/53 |
| 5,463,794 A | * | 11/1995 | Erland | B29C 43/3607 16/225 |
| 6,149,998 A | * | 11/2000 | Hettinga | E05D 1/02 156/308.4 |

(Continued)

*Primary Examiner* — Chuck Y Mah

(74) *Attorney, Agent, or Firm* — McHale & Slavin, P.A.

(57) ABSTRACT

The present invention provides an encapsulated flexible hinge that is particularly suited for use as an original part or as a replacement hinge on a cooler. The encapsulated flexible hinge is comprised of a flexible woven central reinforcement member having a rubber or polymer coating that has been forced through the reinforcement member to create an outer and an inner rubber coating that encapsulates the reinforcement member. In another embodiment, the inner and outer coating is comprised of the same or two different materials that are vulcanized together after being extruded on either side of the reinforcement member. The encapsulated flexible hinge may take on various shapes, and can be cut into a specific shape if need be.

19 Claims, 4 Drawing Sheets

(56) References Cited

U.S. PATENT DOCUMENTS

| | | | | |
|---|---|---|---|---|
| 7,582,345 | B2 * | 9/2009 | Priegelmeir | B32B 1/04 428/60 |
| D607,709 | S * | 1/2010 | Mizon | D8/328 |
| 8,438,702 | B2 * | 5/2013 | Apgar | B32B 25/10 16/225 |
| 8,999,474 | B2 * | 4/2015 | Casteras | B64G 1/222 16/221 |
| 9,038,241 | B2 * | 5/2015 | Masini | E05D 3/02 |
| 9,309,704 | B2 * | 4/2016 | Gouge | E05D 3/02 |
| 9,797,439 | B2 * | 10/2017 | Masini | E05D 1/00 |
| 2002/0038684 | A1 * | 4/2002 | Puppin | B29C 70/50 156/88 |
| 2012/0266430 | A1 | 10/2012 | Richardson, III | |
| 2013/0276266 | A1 * | 10/2013 | Pendarvis | E05D 1/02 16/225 |
| 2015/0040349 | A1 * | 2/2015 | Malia | A63H 27/02 16/225 |
| 2017/0044808 | A1 * | 2/2017 | Liao | E05D 7/00 |

* cited by examiner

ENCAPSULATED FLEXIBLE HINGES

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/462,814, entitled "ENCAPSULATED FLEXIBLE HINGES", filed Feb. 23, 2017. The contents of the above referenced application are incorporated herein by reference.

FIELD OF THE INVENTION

This invention relates to hinges and, more particularly, to easily securable flexible replacement cooler hinges for coolers.

BACKGROUND OF THE INVENTION

A hinge is generally a mechanical bearing that connects two objects and allows a limited angle of rotation between them. The two objects connected by the hinge rotate relative to each other about a fixed axis of rotation. Hinges may be made of flexible material or of mechanical components having a fixed axis of rotation.

Ice coolers are available in many sizes, colors and styles. The exterior of most coolers vary in material, size, and shape; however, most coolers are fitted with at least one working part comprised of a hinge, which is conventionally made of plastic and connected between the lid portion of the cooler and the ice box portion to allow the lid member to be pivoted between an open and a closed position. The length of the lid provides a lever arm to the hinge, subjecting the hinge to large shear stress loads when weight or torque is applied to the lid. The lid member of the cooler is thus susceptible to the most abuse by a user, as the lid is constantly being opened and closed for the purpose of entry into the interior of the cooler. The lid member may also be subject to loads from being used as a seat, even when the lid is in the closed position, directing loads to the hinge. The shear force caused by the loads on the lid member, therefore, often causes the hinges, which are formed as plastic living hinges, to break or tear, causing the lid to become loose with respect to the ice chest. Some repeated loads may even break off the screws, which typically affix the hinge to the exterior of the cooler.

In addition, coolers are often used or stored in sunlit areas. Since most of the hinges are constructed from plastic, sunlight causes degradation of the plastic, making it brittle and easy to break, even from normal use. Thus, cooler owners are often reluctant to go back to the factory for replacement parts that they view as inferior. Thus, there is a need in the art for a cooler hinge that can be utilized as an original part or as a replacement part in the form of a kit. The cooler hinge should be flexible to eliminate the need for exact axial alignment between adjacent hinges to eliminate bind. The cooler hinge should also allow easy opening and closing of the lid member without undue load on the cooler structure. Still yet, the cooler hinge should include an encapsulated flexible reinforcement member so that the reinforcement member provides repeated flexibility while the encapsulation supports the flexible member and provides protection to the flexible member from liquids that could cause mold or deterioration of the flexible member.

SUMMARY OF THE INVENTION

Thus, the present invention provides an encapsulated flexible hinge that is particularly suited for use as an original part or as a replacement hinge on a cooler. The encapsulated flexible hinge is comprised of a flexible woven central reinforcement member having a rubber or polymer coating that has been forced through the reinforcement member to create an outer and an inner rubber coating that encapsulates the reinforcement member. In another embodiment, the inner and outer coating is comprised of the same or two different materials that are vulcanized together after being extruded on either side of the reinforcement member. Both of these constructions are often found in fire hoses, which can be purchased, split and die cut into the desired shape. Alternatively, the material can be produced specifically for the present device and supplied in sheets or rolls which can be die cut into the desired shape. Apertures are provided through the encapsulated flexible hinge for fasteners to secure the encapsulated flexible hinge to the cooler box and lid. The encapsulated hinge may be provided directly from the factory on a cooler assembly, or it may be provided in a kit form as a replacement for original hinges or latches.

Accordingly, it is an objective of the present invention to provide an encapsulated flexible hinge construction which may be utilized as an original part or may be utilized as a replacement part.

It is another objective of the present invention to provide an encapsulated flexible hinge that includes a woven central reinforcement member having a layer of rubber extruded through the reinforcement member to create a layer of rubber on each side.

It is yet another objective of the present invention to provide an encapsulated flexible hinge that includes an encapsulation that resists heat, abrasion, chemicals and mold.

It is still yet another objective of the present invention to provide an encapsulated hinge having a reinforcement member constructed from a variety of natural and synthetic fibers to allow for the hinge to get wet without rotting, to resist the damaging effects of exposure to sunlight and chemicals, and most importantly, to provide flexibility.

Still another objective of the present invention is to provide a flexible replacement hinge that eliminates the drawbacks associated with previous plastic hinges.

Still yet another objective of the present invention is to provide an encapsulated flexible hinge of simple construction that can be produced easily and inexpensively.

Yet another objective of the present invention s to provide an encapsulated flexible hinge that can be used with various types and models of coolers available on the market.

An even further objective of the present invention is to provide an encapsulated flexible hinge that can be cut into various shapes to accommodate and adapt to various cooler types.

Other objects and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
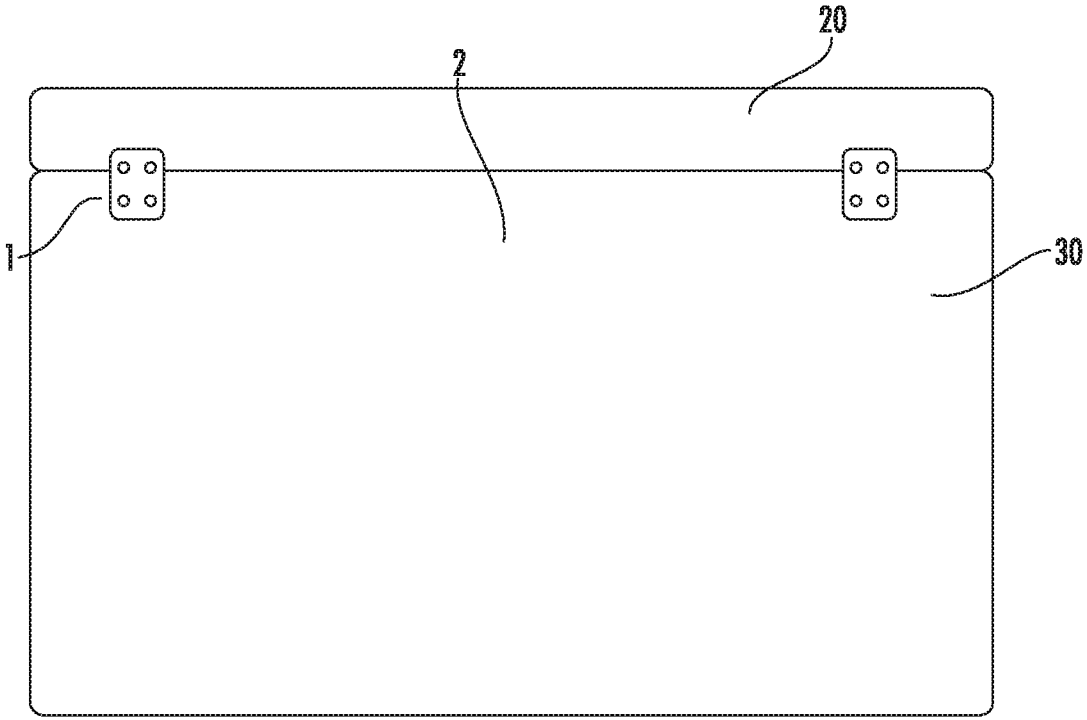
FIG. 1 is a rear view of a cooler including the encapsulated flexible hinge.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 2:
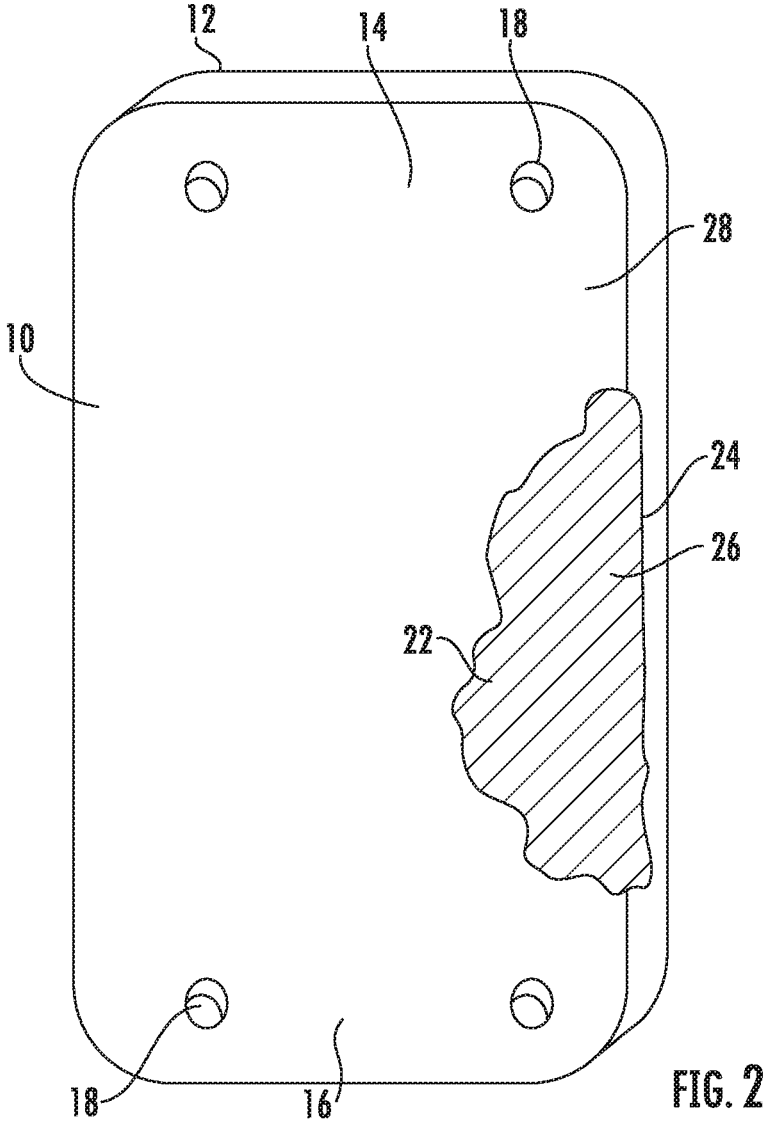
FIG. 2 is an isometric view, partially in section, of one embodiment of the encapsulated flexible hinge.
Figure 3:
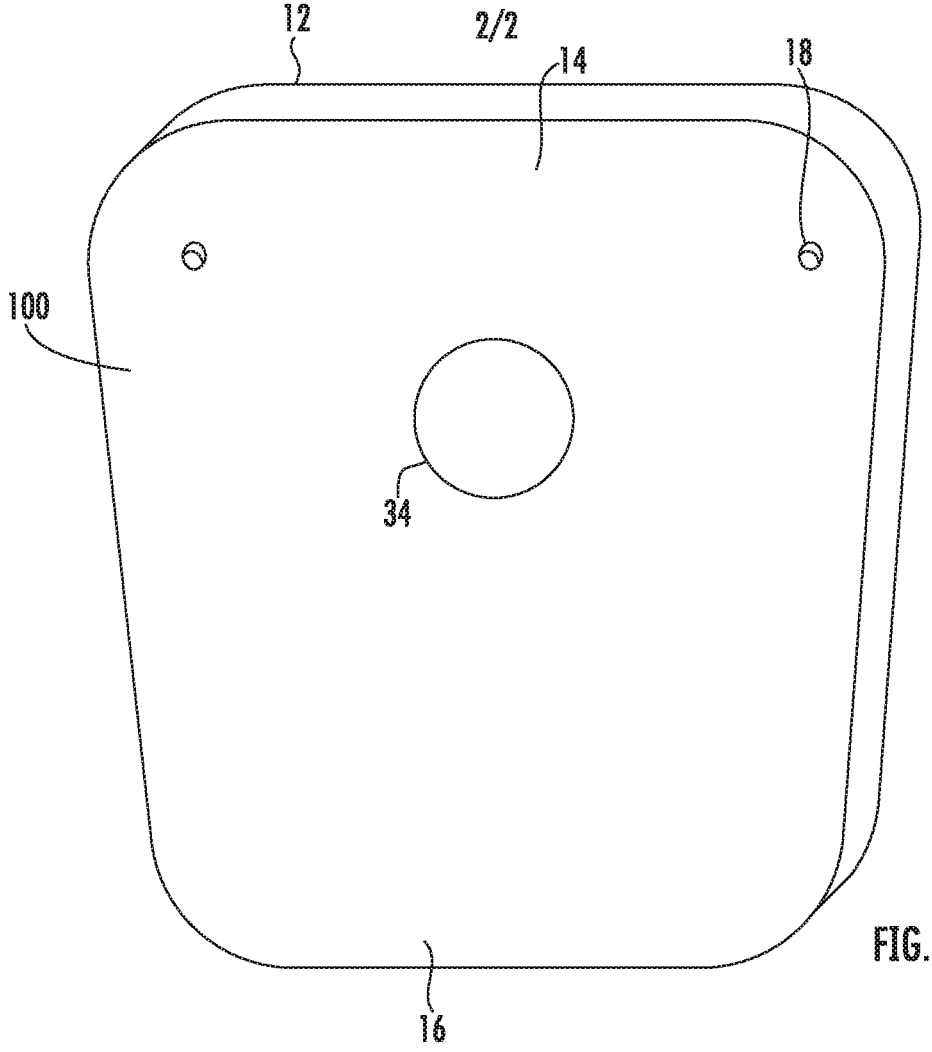
FIG. 3 is an isometric view of a cooler latch constructed from the encapsulated reinforcement member material.

Referring now to FIGS. 1-3, the present invention relates to an encapsulated flexible hinge 1 for use as a hinge between the lid 20 and box 30 of a cooler 2. The encapsulated flexible hinge 1 is comprised of a woven reinforcement member 22 having a front side 10 and back side 12 of a rubber or flexible type polymer extruded through the reinforcement member to encapsulate the fibers of the reinforcement member 22. In a preferred embodiment, the reinforcement member is constructed from polyester 24 and nylon fibers 26 woven into a cross pattern and encapsulated in nitrile rubber 28. The nitrile rubber may be either extruded through the polyester and nylon as a single piece or, alternatively, it may be extruded along both sides of the polyester/nylon and vulcanized once or twice to insure that the nitrile is bonded in and around the polyester/nylon fibers. In the preferred embodiment, the nylon fibers are oriented in the longitudinal direction of the hinge, while the polyester fibers are oriented perpendicular to the nylon fibers. This construction provides the most flexibility to the encapsulated flexible hinge 1 while providing the best stability to prevent side to side flexing of the hinge A top portion 14 and bottom portion 16 of the encapsulated flexible hinge 1 include apertures 18 that extend through the encapsulated flexible hinge 1 from the front side 10 to the back side 12. In one embodiment, the hinge may be constructed from a material such as used fire hose which has been opened into a flat position and die cut with a steel rule, standard dies or by hand. This allows recycling of materials and fast, precise manufacturing while still maintaining low tool cost. This construction also allows a variety of fiber materials to be substituted for the polyester/nylon combination without departing from the scope of the invention. It should also be noted that while the preferred embodiment is described as woven, non-woven, knits, knotted, braided, and stitch through, the construction also allows various polymers that are suitable for encapsulating the fibers to be substituted for the Nitrile without departing from the scope of the invention. The encapsulated construction allows the hinge 1 to get wet repeatedly without rotting or molding, and is resistant to the damaging effects of exposure to sunlight and chemicals. Additionally, the elastic construction provides flexibility and elasticity, which is imperative to operate a cooler top from the open to closed position repeatedly. Still, the polymeric coating provides protection against chafing to the reinforcement member 22, allowing long service life. Additionally, the flexible hinge 1 can take on various shapes, and can be cut into a specific shape if need be. Thus, the flexible replacement hinge 1 can be used with various types and models of coolers available on the market, making the encapsulated flexible hinge 1 universal to most any cooler. Still yet, the flexible construction eliminates the need for multiple adjacently positioned hinges to be axially aligned for proper operation, reducing manufacturing and assembly costs of cooler production.

In at least one embodiment, the hinge may be supplied as a kit for replacing broken or pre-existing cooler hinges. In this embodiment, the hinges are supplied with fasteners, which may be screws, rivets or the like, for securing the encapsulated flexible hinge 1 to the box 30 and lid 20. The encapsulated flexible hinge 1 is used as a replacement by securing the hinge 1 to the cooler 2 using the fasteners, not shown. The fasteners secure the top portion 14 of the hinge 1 to the lid 20 using the provided apertures 18, while the bottom portion of the hinge 16 is secured to the box 30 using the provided apertures 18.

Figure 4:
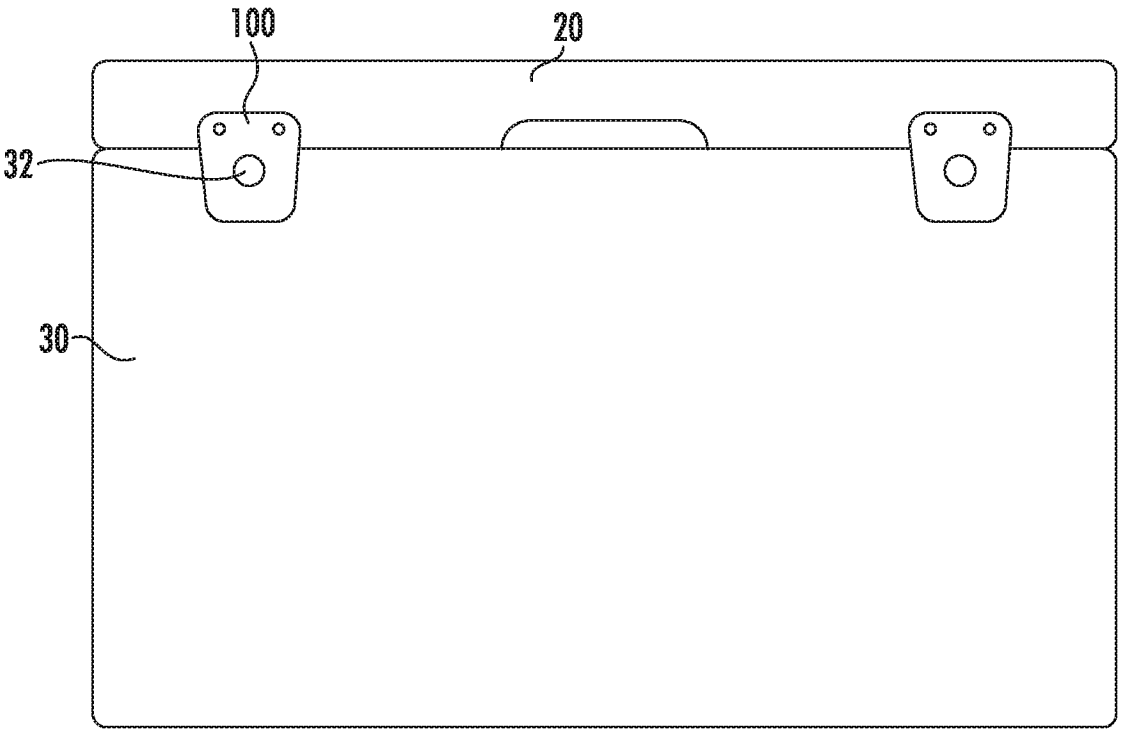
FIG. 4 is a front view of the cooler including the latch constructed from the encapsulated reinforcement member material.

Referring to FIGS. 3 and 4, an encapsulated flexible latch 100 is illustrated. The encapsulated flexible latch 100 is constructed from the same materials as the encapsulated flexible hinge 1 and operates in the same manner. The encapsulated flexible latch 100 is secured to the lid 20 of the cooler 2, and a pin member 32 or hook (not shown) is provided on the front portion of the box 30. Latch aperture 34 is provided to slip over the pin member 32 to hold the lid in a closed position. Release of the latch is accomplished by flexing the encapsulated flexible latch 100 sufficiently to allow the latch to be free from the pin, thereby allowing the lid to open as desired. Since the encapsulated flexible latch 100 is constructed from like materials as the flexible hinge, its construction provides the same advantages to the latch as are seen in the hinge. It should be noted that while the present device is described as being useful for coolers, it could also be used for applications such as, but not limited to, tackle boxes, tool boxes, deck boxes, and the like having hard component parts. It should be noted that while the preferred embodiment includes the reinforcement member, other embodiments may be constructed using only the vulcanized rubber or the two layers of rubber vulcanized together without departing from the scope of the invention.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An encapsulated flexible hinge comprising:

a fibrous reinforcement member having a front side and back side, said fibrous reinforcement member formed from a plurality of threads interlaced with respect to each other, said fibrous reinforcement member cut into a polygonal shape having a plurality of edges, a front surface and a back surface, a plurality of apertures extending through said fibrous reinforcement member, said front surface and said back surface;

a polymer coating encapsulating said plurality of threads, forming said reinforcement member, said polymer coating is extruded through the reinforcement member to encapsulate said plurality of threads, forming said encapsulated flexible hinge;

said plurality of apertures positioned to allow said encapsulated flexible hinge to be attached to a fixed member and a moveable member with fasteners, said encapsulated flexible hinge spanning a gap between said fixed member and said moveable member to allow said moveable member to pivot a limited amount about an axis created by said encapsulated flexible hinge.

2. The encapsulated flexible hinge of claim 1 wherein said polymer is rubber.

3. The encapsulated flexible hinge of claim 2 wherein said rubber is a nitrile rubber.

4. The encapsulated flexible hinge of claim 1 wherein said fibrous reinforcement member is constructed from polyester fibers.

5. The encapsulated flexible hinge of claim 1 wherein said fibrous reinforcement member is constructed from nylon fibers.

6. The encapsulated flexible hinge of claim 1 wherein said fibrous reinforcement member is constructed from polyester and nylon fibers woven into a cross pattern.

7. The encapsulated flexible hinge of claim 1 wherein said fibrous reinforcement member is constructed from polyester and nylon fibers knit into interlocked loops, forming a pattern.

8. The encapsulated flexible hinge of claim 3 wherein said nitrile rubber is extruded along both sides of said fibrous reinforcement member and vulcanized at least once to insure that the nitrile is bonded in and around said fibrous reinforcement member.

9. The encapsulated flexible hinge of claim 6 wherein said nylon fibers are oriented in the longitudinal direction of encapsulated flexible hinge, while said polyester fibers are oriented perpendicular with respect to said nylon fibers.

10. The encapsulated flexible hinge of claim 1 wherein said encapsulated flexible hinge is constructed from fire hose.

11. The encapsulated flexible hinge of claim 1 wherein said encapsulated flexible hinge is rectangular in perimeter shape.

12. The encapsulated flexible hinge of claim 1 wherein said encapsulated flexible hinge is utilized as a latch, said latch being secured along one edge while a second edge is free to flex by hand, whereby said second edge may be flexed so that a latch aperture extends over a pin member to function to secure said pivotable member.

13. The encapsulated flexible hinge of claim 1 wherein said encapsulated flexible hinge is provided as a kit, said kit including at least one said encapsulated flexible hinge and a plurality of fasteners.

14. The encapsulated flexible hinge of claim 13 wherein said kit includes at least two said encapsulated flexible hinges.

15. The encapsulated flexible hinge of claim 13 wherein said fasteners are screws.

16. The encapsulated flexible hinge of claim 13 wherein said fasteners are rivets.

17. An encapsulated flexible hinge comprising:

a fibrous reinforcement member having a front side and back side, said fibrous reinforcement member formed from a plurality of polyester and nylon fibers woven into a cross pattern with respect to each other, said fibrous reinforcement member cut into a polygonal shape having a plurality of edges, a front surface and a back surface, a plurality of apertures extending through said woven reinforcement member, said front surface and said back surface;

a polymer coating extruded through said reinforcement member encapsulating said polyester and nylon fibers, forming said reinforcement member, said polymer coating covering said front surface and said back surface, forming said encapsulated flexible hinge;

said plurality of apertures positioned to allow said encapsulated flexible hinge to be attached to a fixed member and a moveable member with fasteners, said encapsulated flexible hinge spanning a gap between said fixed member and said moveable member to allow said moveable member to pivot a limited amount about an axis created by said encapsulated flexible hinge.

18. The encapsulated flexible hinge of claim 17 wherein said polymer coating is a nitrile rubber.

19. The encapsulated flexible hinge of claim 18 wherein said encapsulated flexible hinge is provided as a kit, said kit including at least one said encapsulated flexible hinge and a plurality of fasteners.

* * * * *